US006193575B1

(12) United States Patent
Nakatani

(10) Patent No.: US 6,193,575 B1
(45) Date of Patent: Feb. 27, 2001

(54) METHOD AND APPARATUS FOR SECURING DISTANCE OF SPARK DISCHARGE GAP OF SPARK PLUG BY MEANS OF IMAGE DATA PROCESSING

(75) Inventor: Hiroshi Nakatani, Kuwana (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/476,110

(22) Filed: Jan. 3, 2000

(30) Foreign Application Priority Data

Jan. 6, 1999 (JP) ..... 11-001392

(51) Int. Cl.[7] ..... H01T 21/02
(52) U.S. Cl. ..... 445/4; 445/7
(58) Field of Search ..... 445/4, 7

(56) References Cited

U.S. PATENT DOCUMENTS 5,725,405 * 3/1998 Nakatani ..... 445/4
5,741,963 4/1998 Nakatani et al. .

FOREIGN PATENT DOCUMENTS 8-45645 2/1996 (JP) .
2636814 4/1997 (JP) .

* cited by examiner

*Primary Examiner*—Kenneth J. Ramsey
(74) *Attorney, Agent, or Firm*—Pillsbury Winthrop LLP

(57) ABSTRACT

In a method or an apparatus for adequately securing a predetermined distance of a spark discharge gap of a spark plug by means of an image data processing, the image data taken by a camera are processed in a manner that a measurement is made on the image data along each of a plurality of measurement lines nearly parallel to each other connecting the center and ground electrodes so as to cover an entire range of a width length of the center electrode in order to obtain a plurality of values of the distance of the spark discharge gap along the measurement lines.

10 Claims, 4 Drawing Sheets

METHOD AND APPARATUS FOR SECURING DISTANCE OF SPARK DISCHARGE GAP OF SPARK PLUG BY MEANS OF IMAGE DATA PROCESSING

CROSS REFERENCE TO RELATED APPLICATION

This application is based upon and claims the benefit of priority of Japanese Patent Application No. H.11-1392 filed on January 6, the content of which is incorporated herein by reference.

BACKGROUND OF THE INVENTION

1. Field of the Invention

The present invention relates to a method and an apparatus for securing a distance of a spark discharge gap of a spark plug, in particular, by means of image data processing based on a plurality of measurement lines.

2. Description of Related Art

A spark plug has generally a center electrode fitted through an insulator into a housing and a ground electrode fixed to the housing. The center electrode partly exposed out of the insulator faces the ground electrode with a predetermined distance of spark discharge gap therebetween.

To secure the predetermined distance of spark discharge gap, a conventional method or apparatus has steps or means of holding the spark plug, reducing the distance of the spark discharge gap by pressing the ground electrode, taking a picture of the spark discharge gap by a CCD camera as image data and processing the image data.

According to the method or apparatus mentioned above, a measurement is generally conducted along a center axis of the center electrode to detect the distance of the spark discharge gap. That is, as shown in FIG. 5A, the measurement is conducted along a measurement line J5 at a center portion (center axis) of the center electrode, in the spark plug in which the insulator J4 holding the inside center electrode J3 is assembled and fitted to the housing J2 holding the outside ground electrode J1.

However, when the insulator J4 is assembled to the housing J2, there is a fear that a center axis (a measurement line J6) of the insulator J4, that is, the center axis of the center electrode J3 is shifted from a center axis (the measurement line J5) of the housing J2, as shown in a dotted line of FIG. 5A. As the camera for taking the picture of the spark discharge gap is positioned with respect to the housing J2 as a reference position, the position relationship between the camera and the insulator J4 may be varied, as the case may be. Therefore, the measurement line for detecting the distance of the spark discharge gap is not always on the center axis of the center electrode and, when the center electrode J3 is slender, may locate outside the center electrode J3.

To cope with the problem mentioned above, there is a way that the position of the measurement line is corrected with respect to the center electrode as the reference position. However, only one of the measurement line is not sufficient to secure an accurate distance of the spark discharge gap.

For example, when the center electrode J3 has a protruding portion J7 such as a burr at an edge thereof, as shown in FIG. 5B, the spark discharge gap is practically on a line through the protruding portion J7, on which a minimum distance of the spark discharge gap is formed. However, as the measurement is made along the center axis (measurement line J5 in FIG. 5B) of the center electrode J3, the distance between the center portions of the center electrode J3 and the ground electrode J1 is incorrectly recognized as the distance of the spark discharge gap. In another words, there is a possibility that, even if an unusual shaped portion such as the burr mentioned above exists partly on the center electrode J3, the unusual shaped portion is overlooked.

SUMMARY OF THE INVENTION

The present invention has been made in view of the above mentioned problems, and an object of the present invention is to provide a method or apparatus for adequately securing a predetermined distance of a spark discharge gap of a spark plug by means of an image data processing.

To achieve the above object, the spark plug is held at first and, then, a picture of a portion around the spark discharge gap is taken to obtain image data, while the ground electrode is pressed to reduce the distance of the spark discharge gap. Next, the image data are processed in a manner that a measurement is made on the image data along each of a plurality of measurement lines nearly parallel to each other connecting the center and ground electrodes so as to cover an entire range of a width length of the center electrode in order to detect the distance of the spark discharge gap. Finally, pressing the ground electrode is stopped when the distance of the spark discharge gap reaches a predetermined value.

As the plurality of the measurement lines covering the entire region of the width length of the center electrode are provided, the length of the spark discharge gap can be adequately secured, even if the center electrode is eccentrically positioned and, further, minimum, maximum and average values of the distance of the spark discharge gap ranging over the entire width length of the center electrode may be controlled.

For example, when the center electrode has a burr, at which the minimum distance of the spark discharge gap is established, it may be recognized by checking a difference value between the minimum distance and the maximum distance that the minimum distance so established is not adequate. As a result, the spark plug having an unusual shape may be detected and eliminated. Therefore, the predetermined distance of the spark discharge gap 13 according to the method or apparatus of the present invention can be more accurately secured, compared with the conventional method or apparatus using only one of the measurement line.

As another aspect of the present invention, the entire width length of the center electrode based on the image data on a reference line passing across the center electrode in a direction of the width thereof is detected. Thus, the width length of the center electrode may be easily detected. Further, it is preferable that the plurality of measurement lines are perpendicular to the reference line to cover the entire range of the width length of the center electrode.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

Figure 1:
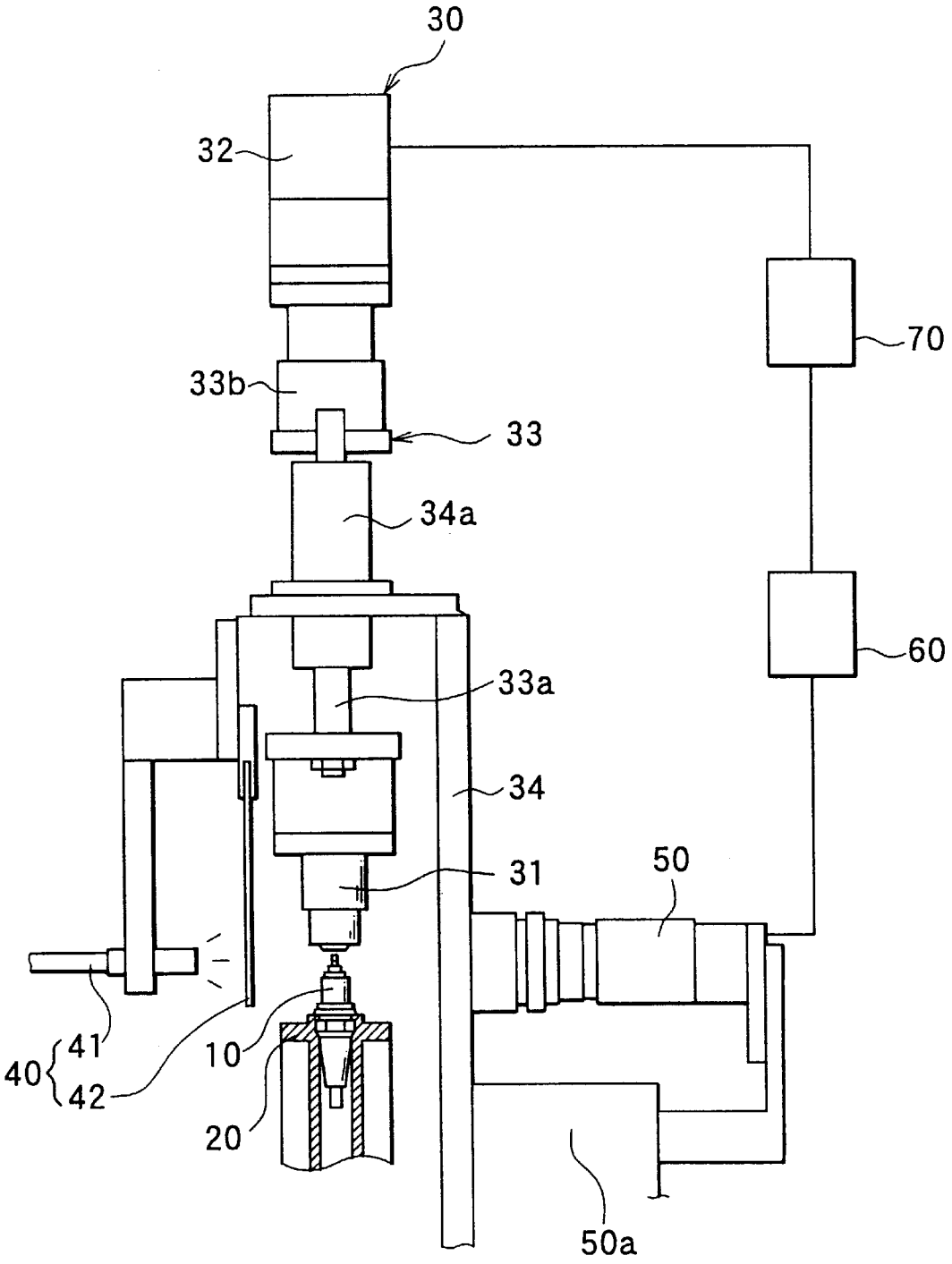
FIG. 1 is a view of an apparatus for adjusting a distance of a spark discharge gap of a spark plug according to an embodiment of the present invention.
Figure 2:
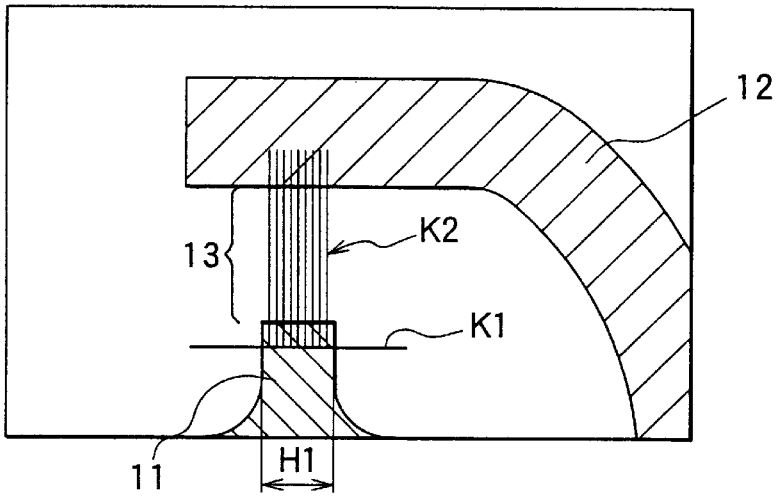
FIG. 2 is a partly enlarged view of the spark discharge gap of the spark plug shown in FIG. 1.

As shown in FIGS. 1 and 2, a spark plug 10 is provided with a center electrode 11 held by an insulator and a ground electrode 12 directly facing a leading end of the center electrode 11. A distance (confronting distance) between the center and ground electrodes 11 and 12 confronting each other constitutes a distance of a spark discharge gap 13.

An apparatus for adjusting the distance of the spark discharge gap, as shown in FIG. 1, is composed of a holder for folding the spark plug 10 to turn the spark discharge gap 13 to an upper side, a ground electrode pressing unit 30 for pressing the ground electrode 12 so as to reduce the confronting distance between both of the electrodes 11 and 12, photo devices comprising a light emitting device 40 and a camera 50, both of which are arranged respectively at opposite sides of the ground electrode pressing unit 30, a confronting distance detecting device 60 for processing image data taken by the camera 50 for detecting the distance of the spark discharge gap 13, and a control unit 70 for controlling the ground electrode pressing unit 30.

FIG. 2 shows the spark discharge gap 13 viewed from a right side of FIG. 1. The ground electrode pressing unit 30 is composed of a press head 31 for pressing the ground electrode 12, a servo motor 32 for moving up and down the press head 31, a joint shaft portion 33 connecting the press head 31 and the servo motor 32, and a base unit 34 fixed to a base (not shown) for holding the joint shaft portion 33 to be moved up and down.

As the construction of the joint shaft portion 33, a leading end of an output shaft 33*a* is connected to the servo motor 32 through a joint 33*b*, the output shaft 33*a* is inserted into a ball screw unit 34*a* mounted on the base unit 34 and the press head 31 is fixed to another leading end of the output shaft (lower side in FIG. 1).

As an operation of the ground electrode pressing unit 30, the servo motor 32 is driven for moving the press head 31 and the joint shaft portion 33 so that the press head 31 may come in contact with and press the ground electrode 12. A pressing speed of the ground electrode pressing unit 30, that is, an up and down moving speed of the press head 31 is controlled by a command to the servo motor 32 from the control unit 70.

The light emitting device 40 is composed of optical fibers 41 as a source of light and a diffusion plate 42 for uniformly distributing a light from the optical fibers 41 to an entire region of the spark discharge gap between the center and ground electrodes 11 and 12. The optical fibers 41 and the diffusion plate 42 are fixed to a side of the base unit 34. The camera 50 fixed to a mounting portion 50 at a side of the base unit 34 is constituted by a CCD camera. Image data taken by the camera 50 is transferred to the confronting distance detecting device 60. An optical axis of the camera 50 nearly coincides with an optical axis of the optical fibers.

The confronting distance detecting device 60 is constituted by an image processing device incorporating a widely used image processing processor and is operative for processing the image data output from the camera 50 according to a given algorithm to detect, for example, a minimum, maximum or average confronting distance between the center and ground electrodes 11 and 12. As the algorithm mentioned above is well known, the explanation is omitted.

The control unit is constructed by, for example, a programmable logic controller (PLC) and controls the servo motor 32 in response to the confronting distance measured by the confronting distance detecting device 60 so as to change the press speed of the press head 31. In more detail, the ground electrode pressing unit 30 is operative in such a manner that the press head 31 continues to move to press the ground electrode 12 until the confronting distance reaches a predetermined value and, when the confronting distance reaches the predetermined value, the press head 31 stops moving so that pressing the ground electrode 12 may be stopped and, then, the press head 31 moves upward to return.

Figure 3:
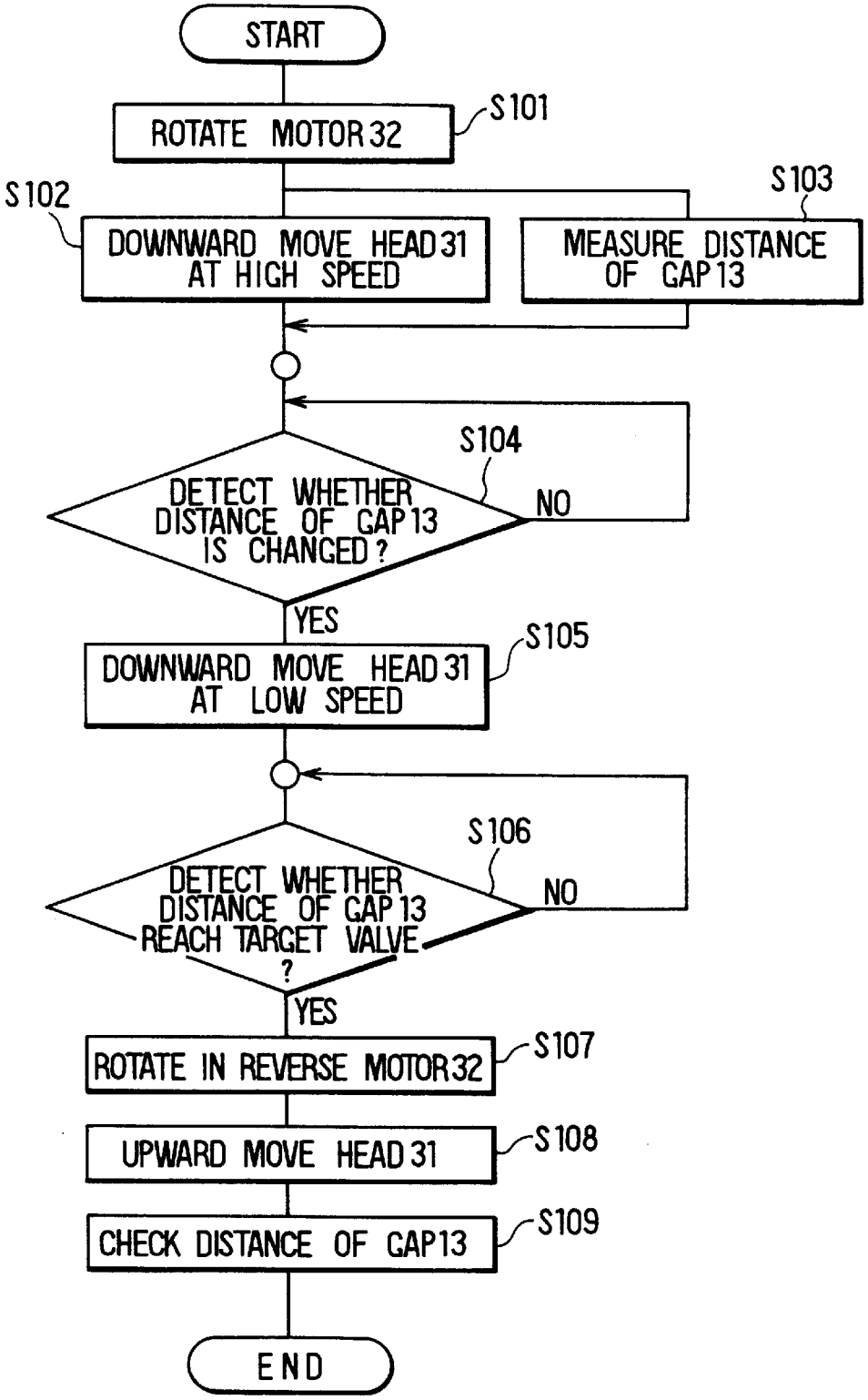
FIG. 3 is a flow chart showing steps of a method for adjusting the distance of the spark discharge gap according to the embodiment of the present.
Figure 5A:
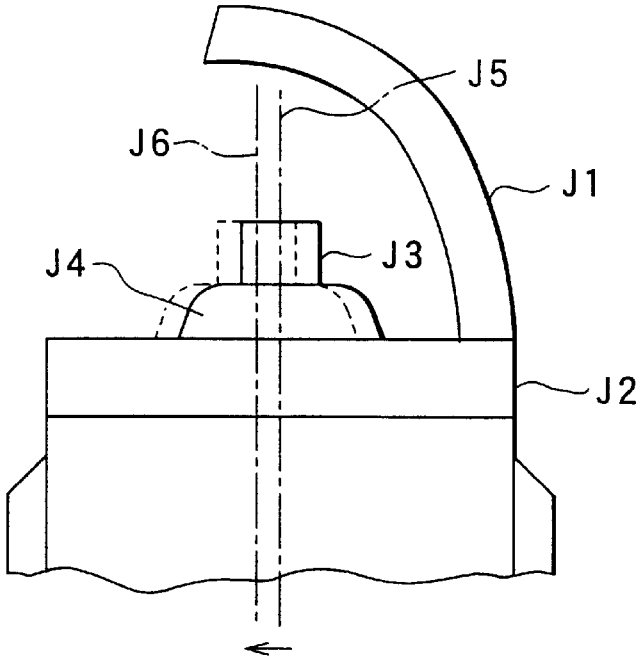
FIG. 5A is a view of a part of the spark plug for explaining a problem of a conventional method for adjusting the distance of the spark discharge.
Figure 5B:
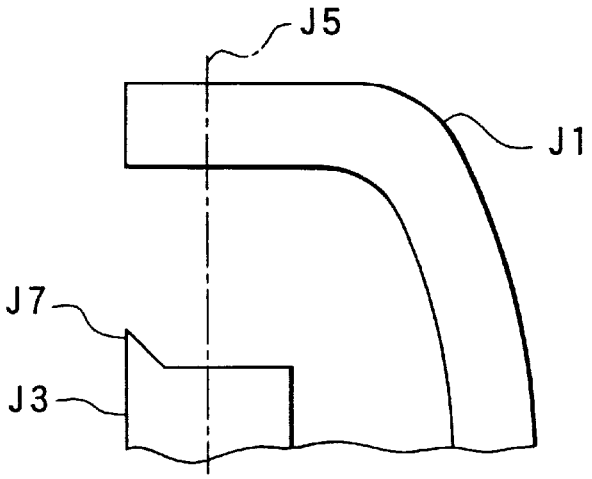
FIG. 5B is a view of a part of the spark plug for explaining another problem of a conventional method for adjusting the distance of the spark discharge.

The operation of the apparatus for adjusting the distance of the spark discharge gap is described hereinafter with reference to a flow chart shown in FIG. 3. At first, the spark plug 10 is fixed manually or by an automatic handling device to the holder 20 so as to turn the spark discharge gap 13 to an upside. Before the spark plug 10 is fixed to the holder 20, the ground electrode is tentatively bent to constitute a tentative distance of the spark discharge gap 13, which is larger than a final predetermined distance of the spark discharge gap 13 so that the ground electrode 12 may be located at a given position with respect to the holder 20 when the spark plug 10 is fixed to the holder 20.

On turning on a starting switch (not shown), a routine as shown in the flow chart starts. The control unit 70 demands the servo motor 32 to rotate (in a normal direction) so that the press head 31 starts moving downward (S101, S102). A downward moving speed of the press head 31 is controlled by the control unit 70 and is faster than the downward moving speed thereof at the time when the press head 31 comes in contact with and presses the ground electrode 12, which is described later.

The light emitting device 40 emits a light and the camera 50 takes a picture of a region around the spark discharge gap 13. At this time, the confronting distance detecting device 60 detects in real time the confronting distance of the spark discharge gap 13 (S103).

When the press head 31 comes in contact with the ground electrode 12, the confronting distance detecting device 60 also detects a width length H of the center electrode 11 on a reference line K1 passing across the center electrode 11 in the width thereof based on the image data taken by the camera 50. In addition, there is provided with a plurality of measurement lines K2 (for example 10 lines) nearly parallel to each other and perpendicular to the reference line K1 that connect respectively the center electrode 11 with the ground electrode 12 to cover an entire range of the width length H of the center electrode 11. The confronting distance detecting device 60 processes the image data along each of the plurality of the measurement lines K2 for measuring the confronting distance and can detect a timing when the confronting distance begins to be changed.

Pictures of the center and ground electrodes 11 and 12 are taken in black color and a picture of the spark discharge gap 13 is in white color, since the photo device according to the present embodiment is of a permeable light projection type. The confronting distance detecting device 60 recognizes and discriminates between the black and white color portions on the plurality of the measurement lines K2 and detects each white color length along each of the plurality of the measurement lines K2 as each of the confronting distance data at the entire range of the width length H. Therefore, values of minimum, maximum and average confronting distances may be respectively secured from the confronting distance data mentioned above. A length of the reference line K1 is relatively long in view of a possible eccentricity of the center electrode 11.

When the confronting distance begins to be changed, the control unit 70 controls the servo motor 32 to make the downward moving speed of the press head 31 slower. The press head 31 continues to move downward at the slower speed until the value of the minimum confronting distance among the confronting distance data detected along the plurality of the measurement lines K2 reaches a target value stored in the control unit 70 as the predetermined distance of the spark discharge gap (S105).

While detecting whether the value of the minimum confronting distance reaches the target value (S106) and when the value of the minimum confronting distance reaches the target value, the control unit 70 controls the servo motor to rotate in reverse so that the press head 31 may move upward (S107) to stop pressing the ground electrode 12, resulting in stopping the operation of the ground electrode pressing unit 30. Thus, the predetermined distance of the spark discharge gap 13 can be secured in the spark plug 10.

Further, after the predetermined distance of the spark discharge gap 13 is secured, it is checked from and among the confronting distance data such as the values of the minimum, maximum and average confronting distances where or not the predetermined distance of the spark discharge gap 13 so secured depends on an usual shape of the center electrode 11 (S109).

Figure 4:
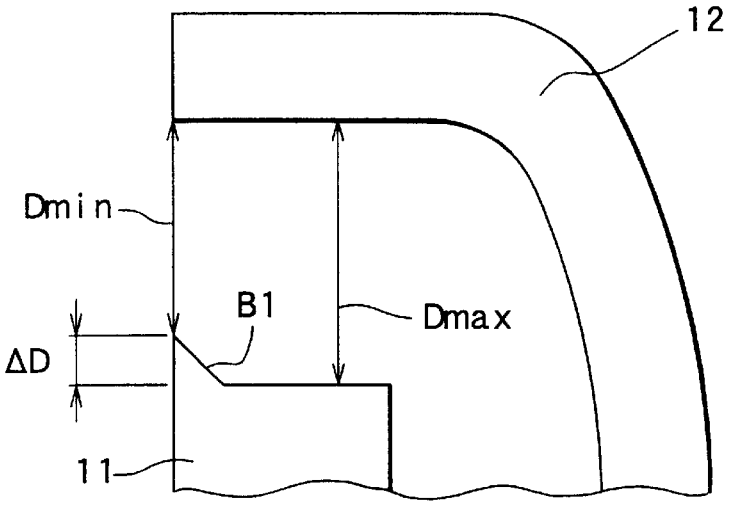
FIG. 4 is a view of a part of the spark plug for explaining the effect according to the embodiment of the present.

For example, when the center electrode 11 has a burr B1 as shown in FIG. 4, the minimum confronting distance is detected as a minimum distance $D_{min}$ on the measurement line passing through the burr B1. However, if the minimum distance $D_{min}$ is shorter by more than a given amount than a maximum distance $D_{max}$, that is, if a difference $\Delta D$ between the maximum distance $D_{max}$ and the minimum distance $D_{min}$ is more than the given amount, it may be recognized and detected that the spark plug 10 has an unusual shape. In this case, as the unusual spark plug 10 may be eliminated, the spark plug 10 is always provided with an adequate distance of the spark discharge gap 13.

According to the present embodiment, with respect to the distance of the spark discharge gap, the method mentioned above makes it possible to control not only the minimum confronting distance but also the other confronting distances covering the entire range of the width length H1 of the center electrode 11 including the maximum confronting distance and the average confronting distance, since a plurality of the confronting distance data along the plurality of the measurement lines K2 at the entire range of the width length H1 of the center electrode 11 are available.

Therefore, in the step of detecting whether the distance is changed (S104) or in the step of deciding whether the minimum distance reaches the target value (S106), the confronting distance data covering the entire width length H1 of the center electrode 11 may be used. As a result, the distance of the spark discharge gap 13 according to the method or apparatus of the present embodiment can be more accurately secured, compared with the conventional method or apparatus using only one of the measurement line.

Furthermore, according to the present embodiment, as the width length H1 of the center electrode 11 is recognized by the reference line K1 and the plurality of the measurement lines K2 covering the entire region of the width length H1 of the center electrode 11 are provided, the length of the spark discharge gap 13 can be adequately secured, even if the center electrode is eccentrically positioned.

What is claimed is:

1. A method for securing a distance of a spark discharge gap between center and ground electrodes of a spark plug comprising the steps of;

holding the spark plug;

taking a picture of a portion around the spark discharge gap to obtain image data, while pressing the ground electrode to reduce the distance of the spark discharge gap;

processing the image data in a manner that a measurement is made on the image data along each of a plurality of measurement lines nearly parallel to each other connecting the center and ground electrodes so as to cover an entire range of a width length of the center electrode in order to detect the distance of the spark discharge gap; and stopping pressing the ground electrode when the distance of the spark discharge gap reaches a predetermined value.

2. A method for securing the distance of the spark discharge gap according to claim 1, further comprising the step of;

detecting the entire width length of the center electrode based on the image data on a reference line passing across the center electrode in a direction of the width thereof.

3. A method for securing the distance of the spark discharge gap according to claim 2, wherein the plurality of measurement lines are perpendicular to the reference line to cover the entire range of the width length of the center electrode.

4. A method for securing the distance of the spark discharge gap according to claim 1, wherein a plurality of values of the distance of the spark discharge gap along the respective plurality of measurement lines are obtained and a minimum value of the distance of the spark discharge gap is used for deciding whether the distance of the spark discharge gap reaches the predetermined value.

5. A method for securing the distance of the spark discharge gap according to claim 4, further comprising the step of;

selecting the spark plug as a failure of the spark plug when, among the values of the distance of the spark discharge gap measured along the respective plurality of measurement lines, the minimum value thereof is shorter by more than a predetermined amount than a maximum value of the distance of the spark discharge gap.

6. An apparatus for securing a distance of a spark discharge gap between center and ground electrodes of a spark plug comprising;

a holder for holding the spark plug;

a photo device for taking a picture of a portion around the spark discharge gap to obtain image data;

a ground electrode pressing unit for pressing the ground electrode to reduce the distance of the spark discharge gap;

a distance detecting device for processing the image data in a manner that a measurement is made on the image data along each of a plurality of measurement lines nearly parallel to each other connecting the center and ground electrodes so as to cover an entire range of a width length of the center electrode in order to detect the distance of the spark discharge gap; and a control device for controlling the ground electrode pressing unit in a manner that the ground electrode is pressed during a time when the picture of the portion around the spark discharge gap is taken and, when the distance detecting device detects the distance of the spark discharge gap reaches a predetermined value, pressing the ground electrode is stopped.

7. An apparatus for securing a distance of a spark discharge gap according to claim 6, wherein the distance detecting device detects the entire width length of the center electrode based on the image data on a reference line passing across the center electrode in a direction of the width thereof.

8. An apparatus for securing a distance of a spark discharge gap according to claim 7, wherein the plurality of measurement lines are perpendicular to the reference line to cover the entire range of the width length of the center electrode.

9. An apparatus for securing a distance of a spark discharge gap according to claim 7, wherein a moving speed of the ground electrode pressing unit for pressing after coming in contact with the ground electrode becomes slower than a moving speed of the ground electrode pressing unit for accessing to the ground electrode before coming in contact with the ground electrode.

10. An apparatus for securing a distance of a spark discharge gap according to claim 7, further comprising;

an eliminating device for selecting and eliminating, as a failure of the spark plug, the spark plug having values of the distance of the spark discharge gap measured along the respective plurality of measurement lines, a dimensional relationship among which is not within a predetermined range.

* * * * *